US010779632B2

(12) United States Patent
Roberts

(10) Patent No.: US 10,779,632 B2
(45) Date of Patent: Sep. 22, 2020

(54) HAIR EXTENSION STORAGE ASSEMBLY

(71) Applicant: Nakei Roberts, Humble, TX (US)

(72) Inventor: Nakei Roberts, Humble, TX (US)

( * ) Notice: Subject to any disclaimer, the term of this patent is extended or adjusted under 35 U.S.C. 154(b) by 354 days.

(21) Appl. No.: 15/873,720

(22) Filed: Jan. 17, 2018

(65) Prior Publication Data

US 2019/0216208 A1 Jul. 18, 2019

(51) Int. Cl.

| | |
|---|---|
| ***A45D 44/04*** | (2006.01) |
| ***A41G 5/00*** | (2006.01) |
| ***A45C 3/00*** | (2006.01) |
| ***A45C 13/42*** | (2006.01) |
| ***A45C 11/00*** | (2006.01) |
| ***A45D 44/02*** | (2006.01) |

(52) U.S. Cl.

CPC ..... *A45D 44/04* (2013.01); *A41G 5/0086* (2013.01); *A45C 3/00* (2013.01); *A45C 11/00* (2013.01); *A45C 13/42* (2013.01); *A45D 44/02* (2013.01); *A45C 2200/10* (2013.01)

(58) Field of Classification Search

CPC ..... A45D 44/04; A45D 44/02; A45C 3/00; A45C 13/42; A45C 11/00; A45C 2200/10; A41G 5/0086; A47G 25/06; A47G 25/0664; A47G 25/0685; A47G 25/0671

See application file for complete search history.

(56) References Cited

U.S. PATENT DOCUMENTS

| | | | | | |
|---|---|---|---|---|---|
| 337,422 | A | * | 3/1886 | Miller | A47F 5/0006 211/115 |
| 843,712 | A | * | 2/1907 | Straub | D06F 57/04 211/197 |
| 2,557,627 | A | * | 6/1951 | Baril | A47G 25/18 211/113 |
| 2,598,614 | A | | 5/1952 | Gilbert | |
| 2,666,559 | A | * | 1/1954 | Wexler | A41H 5/00 223/68 |
| 4,429,797 | A | * | 2/1984 | Collins | A47G 25/743 211/119 |
| 4,949,842 | A | * | 8/1990 | Mokiao, II | A45C 3/00 206/278 |
| D320,118 | S | * | 9/1991 | Testa | D6/317 |
| 5,303,855 | A | | 4/1994 | Veale | |
| 5,458,249 | A | * | 10/1995 | Shang-Lu | D06F 57/04 211/196 |

(Continued)

FOREIGN PATENT DOCUMENTS

WO WO2015089225 6/2015

*Primary Examiner* — Ko H Chan

(57) ABSTRACT

A hair extension storage assembly for storing hair extensions includes a hanger that may be suspended from a support. A member is attached to the hanger and the member is suspended from the support when the hanger is positioned on the support. A plurality of slats is provided and each of the slats is pivotally coupled to the member. Each of the slats is selectively positioned in a deployed position having each of the slats being oriented perpendicular to the member. Each of the slats is positioned in a stored position having each of the slats extending downwardly along the member. A plurality of clips is provided and each of the clips is coupled to an associated one of the slats. Each of the clips releasably engages a hair extension thereby facilitating the hair extension to be stored in a vertical orientation without deforming or crumpling.

10 Claims, 6 Drawing Sheets

(56) References Cited

U.S. PATENT DOCUMENTS

| | | | | |
|---|---|---|---|---|
| 5,813,539 | A | 9/1998 | DePalma | |
| D433,821 | S * | 11/2000 | Brutus | D6/317 |
| D499,255 | S * | 12/2004 | Goodman | D6/317 |
| 8,348,054 | B2 | 1/2013 | Dragan | |
| 8,459,514 | B2 * | 6/2013 | Lagzdins | A47G 25/32 223/89 |
| D688,472 | S | 8/2013 | Cohen | |
| 9,332,820 | B2 | 5/2016 | Bernard | |
| 9,441,785 | B2 | 9/2016 | Sterling | |
| 9,492,021 | B2 | 11/2016 | Kebreau | |
| 9,949,586 | B2 * | 4/2018 | Bennett | A47G 25/743 |
| 2010/0051654 | A1 * | 3/2010 | Thompson | A47G 25/0685 223/88 |
| 2013/0104922 | A1 | 5/2013 | Hall et al. | |

* cited by examiner

HAIR EXTENSION STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for storing hair extensions.

BRIEF SUMMARY OF THE INVENTION

An embodiment of the disclosure meets the needs presented above by generally comprising a hanger that may be suspended from a support. A member is attached to the hanger and the member is suspended from the support when the hanger is positioned on the support. A plurality of slats is provided and each of the slats is pivotally coupled to the member. Each of the slats is selectively positioned in a deployed position having each of the slats being oriented perpendicular to the member. Each of the slats is positioned in a stored position having each of the slats extending downwardly along the member. A plurality of clips is provided and each of the clips is coupled to an associated one of the slats. Each of the clips releasably engages a hair extension thereby facilitating the hair extension to be stored in a vertical orientation without deforming or crumpling.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
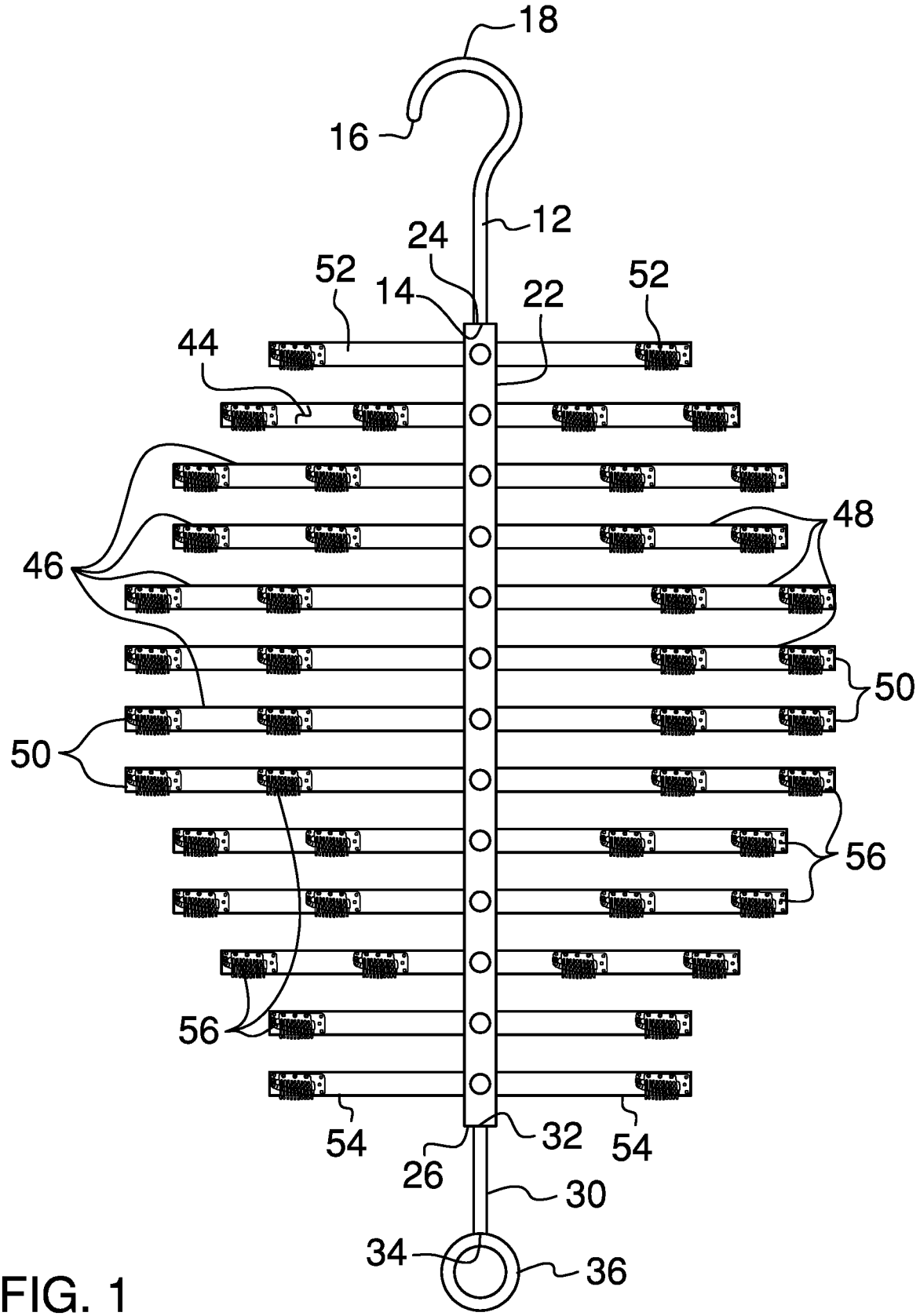
FIG. 1 is a front view of a hair extension storage assembly according to an embodiment of the disclosure.
Figure 2:
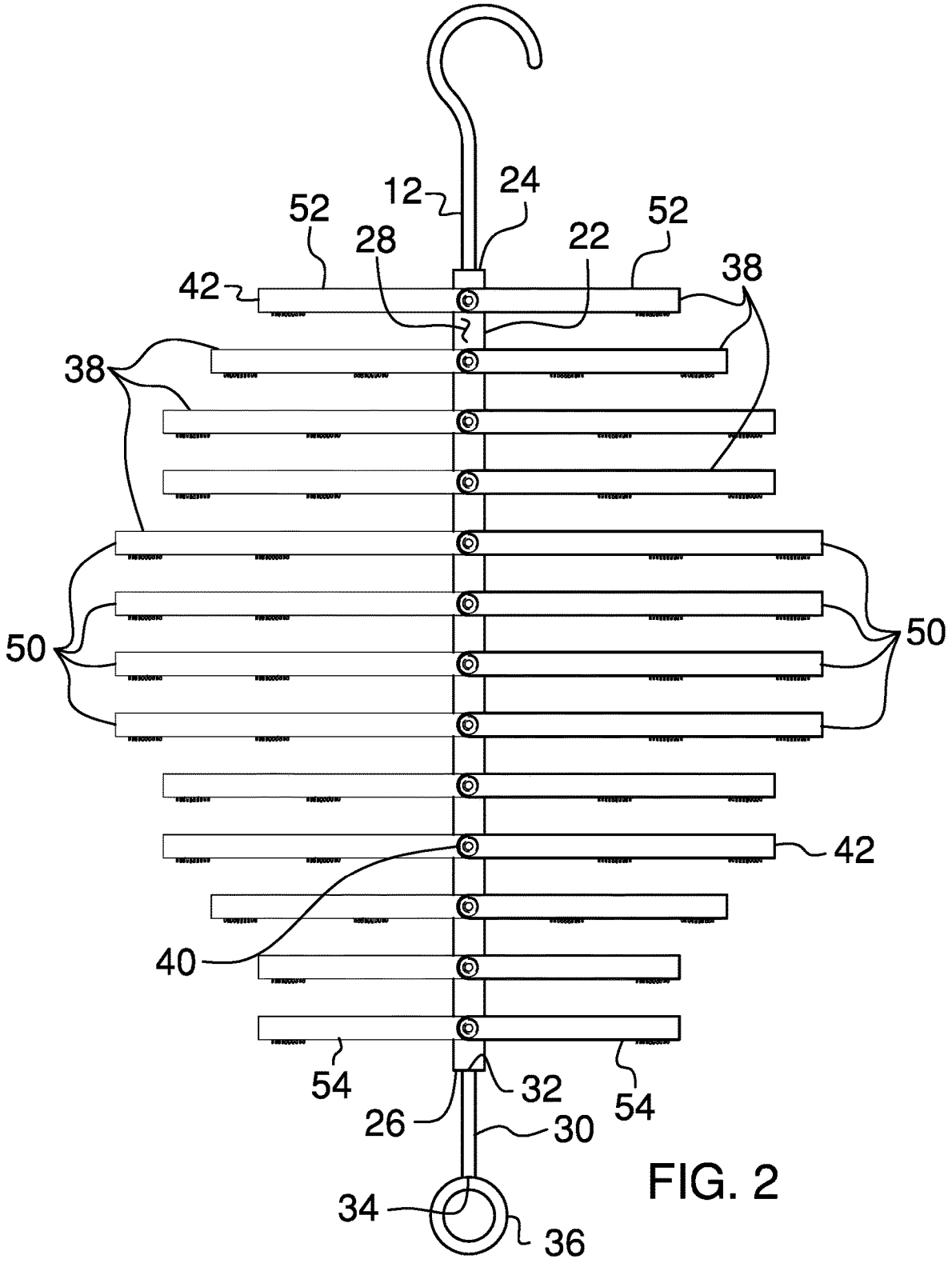
FIG. 2 is a back view of an embodiment of the disclosure showing a plurality of slats in a deployed position.
Figure 3:
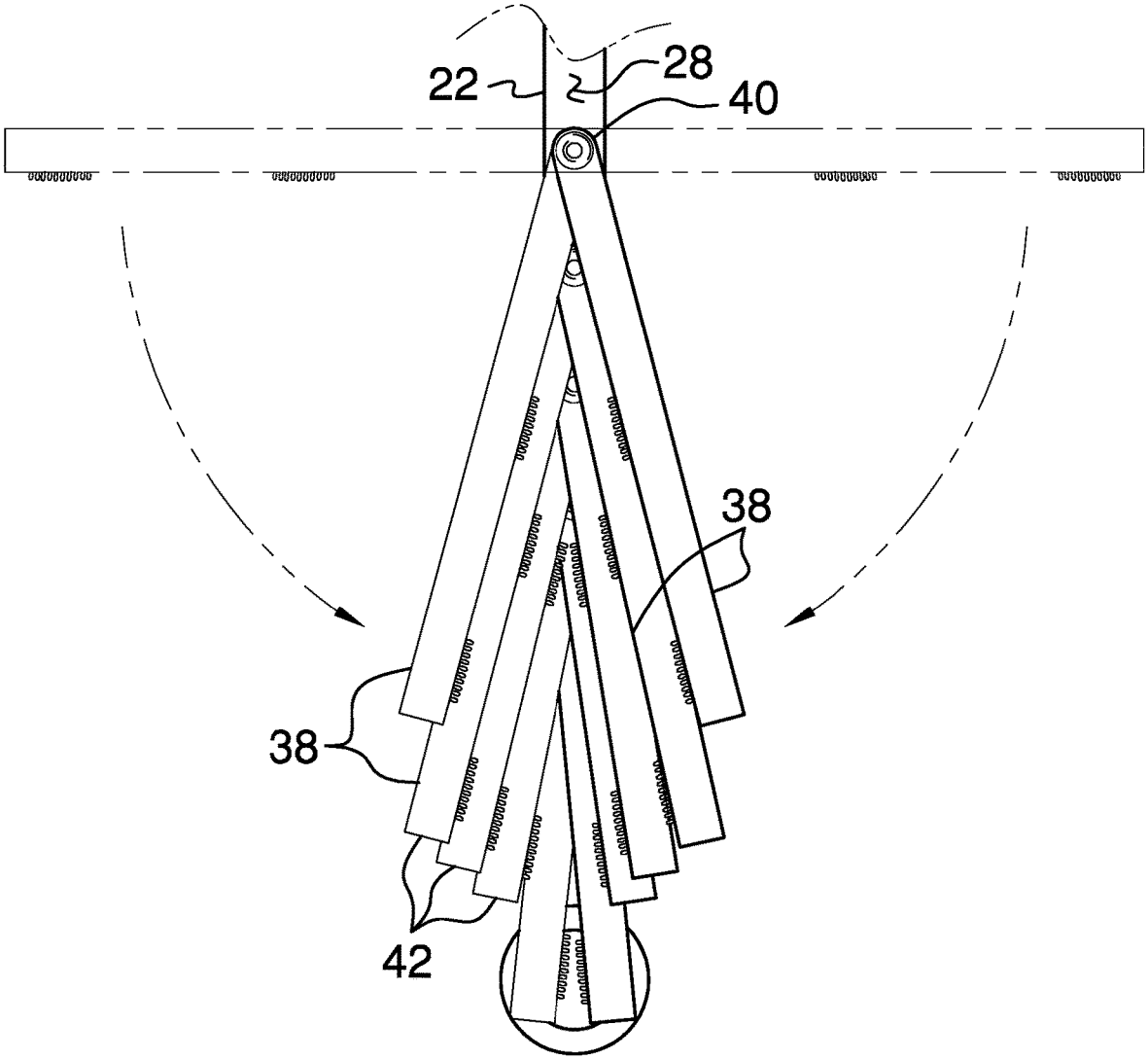
FIG. 3 is a back view of an embodiment of the disclosure showing a plurality of slats in a folded position.
Figure 4:
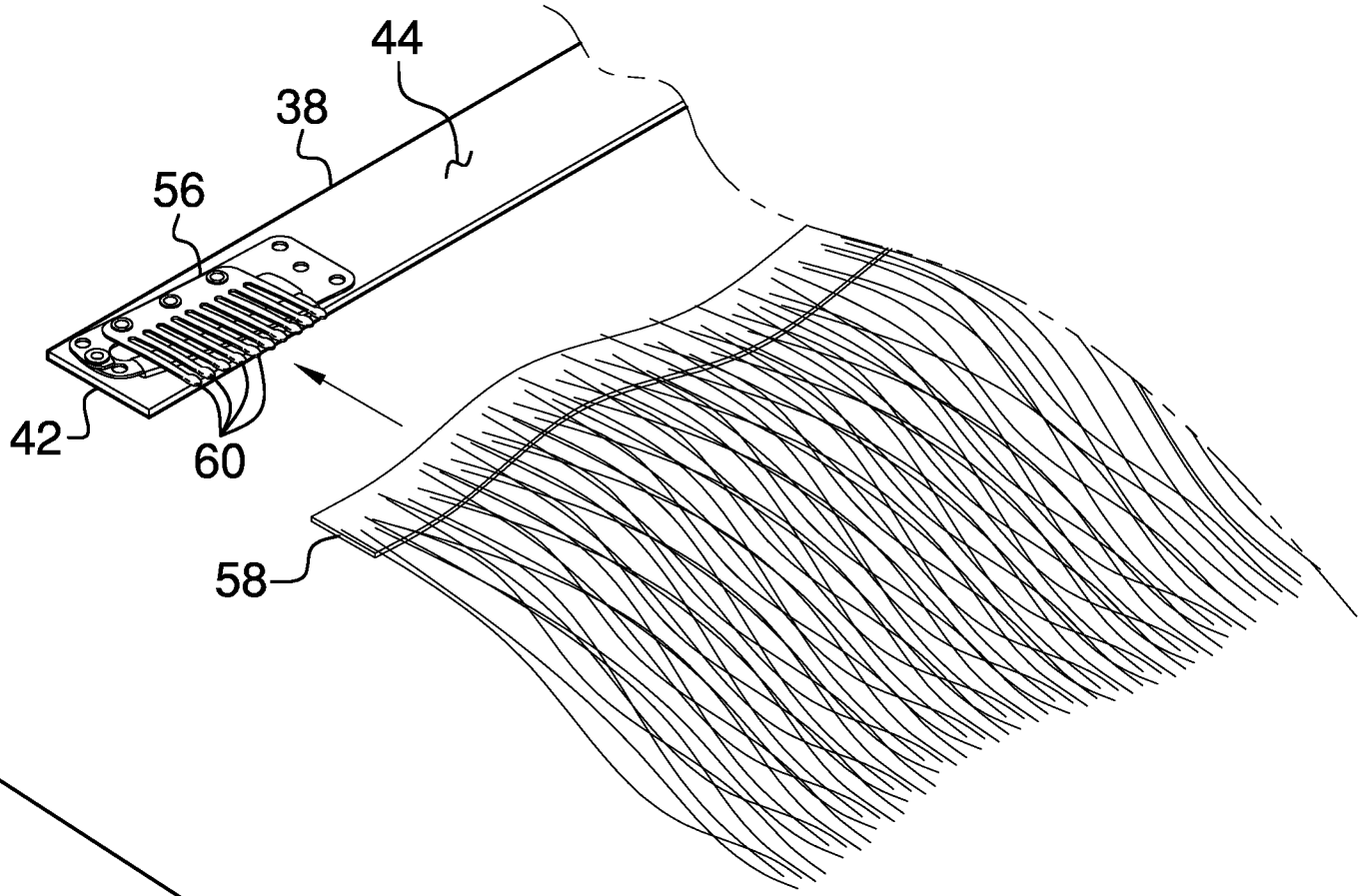
FIG. 4 is a perspective in use view of an embodiment of the disclosure.
Figure 5:
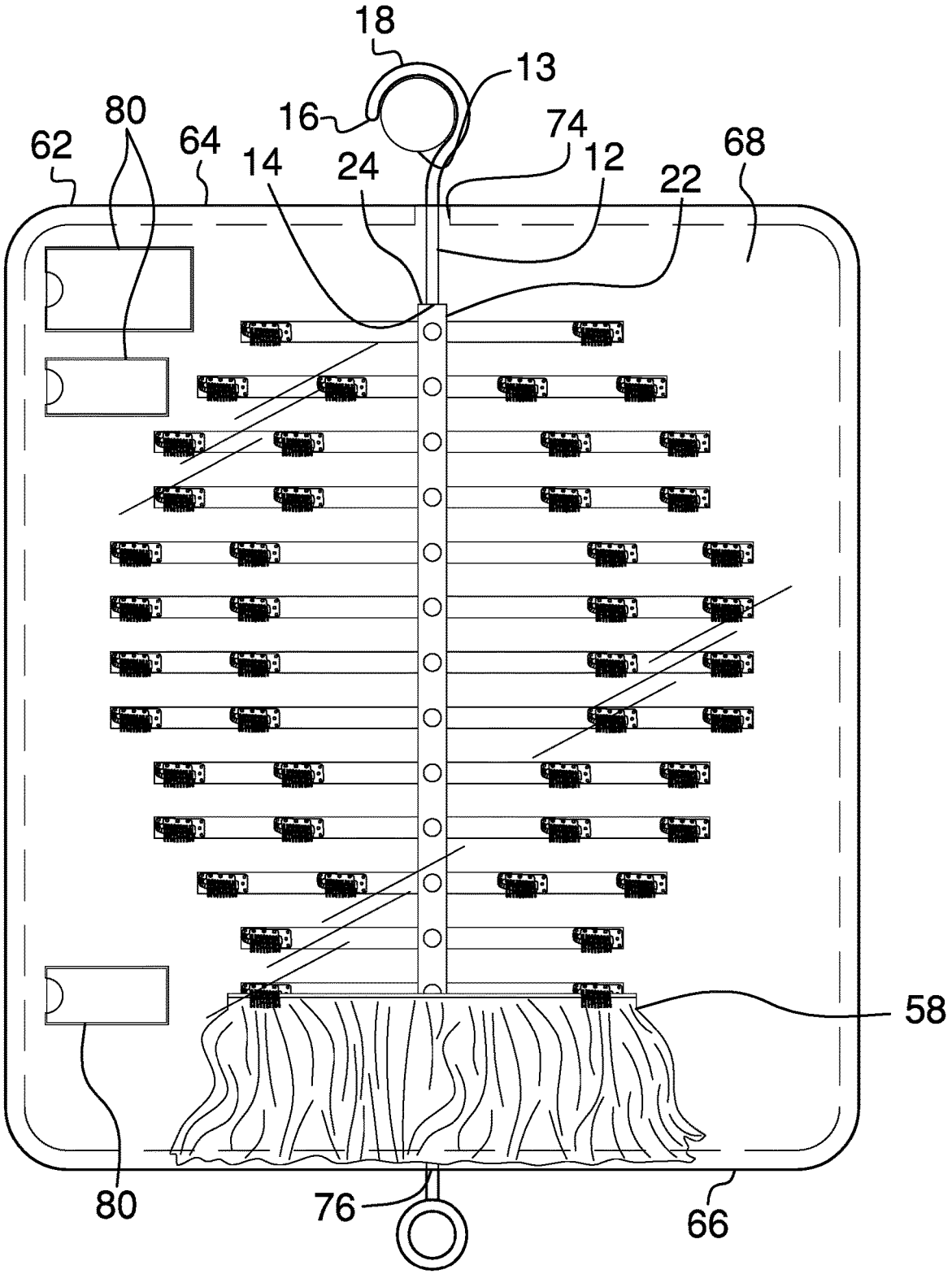
FIG. 5 is a front perspective in-use view of an embodiment of the disclosure.
Figure 6:
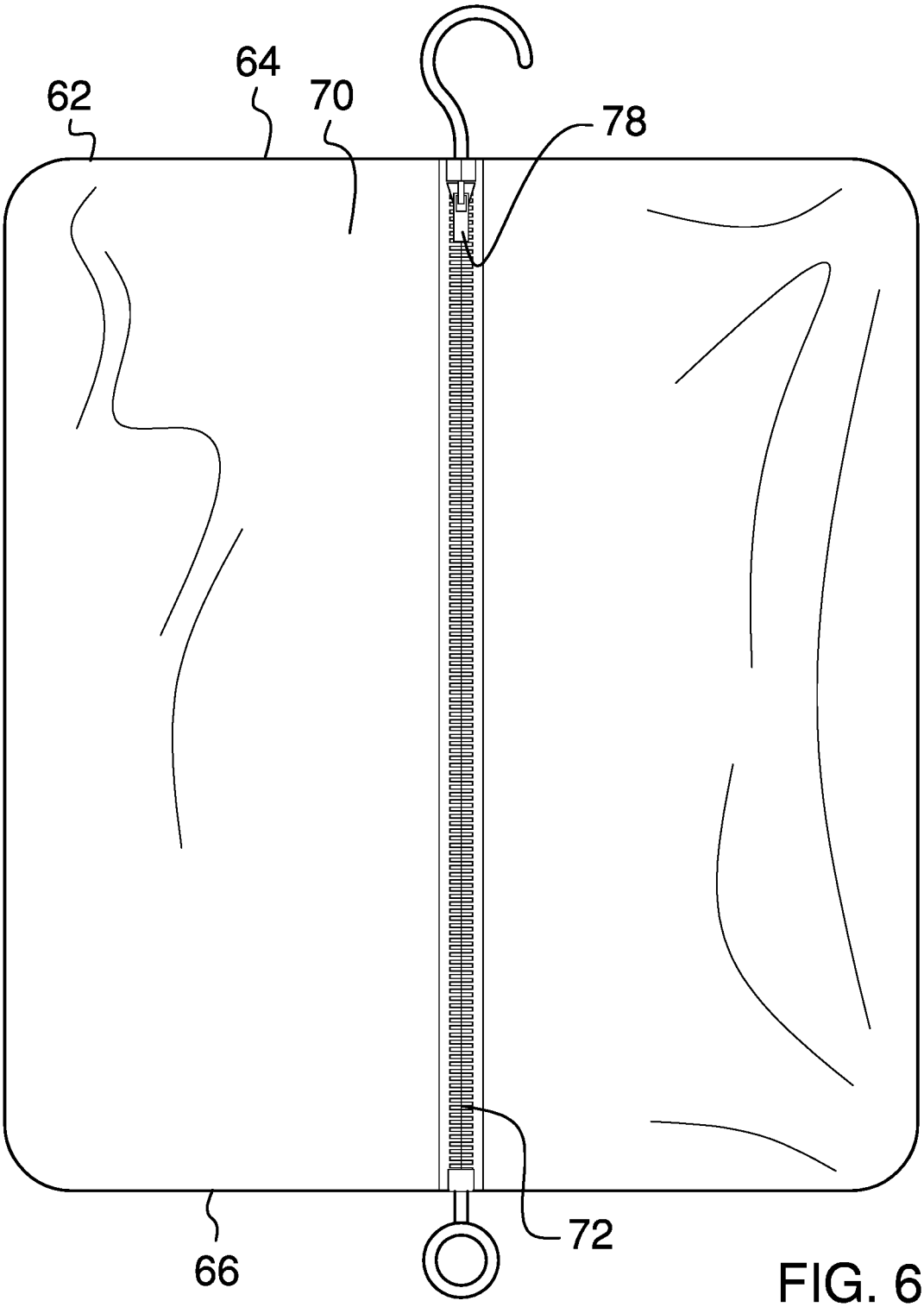
FIG. 6 is a back perspective in-use view of an embodiment of the disclosure.

With reference now to the drawings, and in particular to FIGS. 1 through 6 thereof, a new storage device embodying the principles and concepts of an embodiment of the disclosure and generally designated by the reference numeral 10 will be described.

As best illustrated in FIGS. 1 through 6, the hair extension storage assembly 10 generally comprises a hanger 12 that may be suspended from a support 13 such as a closet pole or the like. The hanger 12 has a first end 14 and a second end 16. The hanger 12 is curved adjacent to the second end 16 such that the second end 16 is directed toward the first end 14 to define a hook 18 for engaging a support 13. A member 22 is attached to the hanger 12 and the member 22 is suspended from the support 13 when the hanger 12 is positioned on the support 13. The member 22 has a first end 24, a second end 26 and a first surface 28 extending therebetween. The second end 16 of the hanger 12 is coupled to the first end 24 of the member 22. The member 22 is elongated between the first end 24 and the second end 26 of the member 22 and the member 22 may have a length ranging between approximately 60.0 cm and 120.0 cm.

A rod 30 is provided that has a first end 32 and a second end 34 and the first end 32 of the rod 30 is coupled to the second end of the member 22. A ring 36 is coupled to the second end of the rod 30 and a hook 18 on an additional member 22 may be suspended from the ring 36. A plurality of slats 38 is provided and each of the slats 38 is pivotally coupled to the member 22. Each of the slats 38 is selectively positioned in a deployed position having each of the slats 38 is oriented perpendicular to the member 22. Additionally, each of the slats 38 is positioned in a stored position having each of the slats 38 extending downwardly along the member 22.

Each of the slats 38 has a first end 40, a second end 42 and a first surface 44 extending therebetween. The first end 40 corresponding to each of the slats 38 is pivotally coupled to the first surface 28 of the member 22. Additionally, the slats 38 are spaced apart from each other and are distributed between the first end 24 and the second end 26 of the member 22. The plurality of slats 38 is arranged into a set of first slats 46 and a set of second slats 48. The first slats 46 extend away from an opposite side of the member 22 with respect to the second slats 48 when the first and second slats 48 are positioned in the deployed position. Each of the set of first slats 46 and the set of second slats 48 includes a plurality of middle slats 50, a topmost slat 52 and a bottommost slat 54 with respect to the member 22. Moreover, the middle slats 50 may have a greater length than each of the topmost 52 and bottommost slats 54.

A plurality of clips 56 is provided and each of the clips 56 is coupled to an associated one of the slats 38. Each of the clips 56 releasably engages a hair extension 58 thereby facilitating the hair extension 58 to be stored without deforming or crumpling. The hair extension 58 may be an artificial hair extension 58 of any conventional design and length. Each of the topmost 52 and bottommost slats 54 may be deployed to accommodate a hair extension 58 of a maximum width. Each of the middle slats 50 corresponding to each of the set of first 46 and second 48 slats has a pair of the clips 56 positioned thereon. Thus, a hair extension 58 of a medium to minimum width may be clipped to each of the middle slats 50.

Each of the clips 56 is positioned on the first surface 44 of the associated slat 38. Moreover, each of the clips 56 includes a plurality of fingers 60 each that is each biased to frictionally engage the first surface 44 of the associated slat 38. The hair extension 58 is positioned between the fingers 60 and the slat 38 to retain the hair extension 58 on the associated slat 38 for storage.

A storage bag 62 is included and the member 22 and each of the slats 38 are selectively positioned therein for transporting the hair extensions 58. The storage bag 62 has a top wall 64, a bottom wall 66, a front wall 68 and a back wall 70. The front wall 68 has a cut 72 extending into an interior of the bag and the cut 72 extends between the top wall 64 and the bottom wall 66. The top wall 64 has a first opening 74 extending into the interior of the bag and the hanger 12 is extended through the first opening 74 when the member 22 and the slats 38 are positioned in the bag. The bottom wall 66 has a second opening 76 extending into the interior of the bag and the rod 30 is extended through the second opening 76 when the member 22 and the slats 38 are positioned in the bag. The back wall 70 is comprised of a translucent material such that the hair extensions 58 are visible in the storage bag 62.

A fastener 78 is coupled to the front wall 68 of the bag and the fastener 78 is coextensive with the cut 72. The fastener 78 selectively opens and closes the cut 72 and the fastener 78 may be a zipper or the like. A plurality of pockets 80 is each coupled to an outer surface of the back wall 70 of the bag. Each of the pockets 80 is comprised of a translucent material and each of the pockets 80 receives and displays a name card or the like to identify ownership of the bag.

In use, each of the slats 38 is selectively positioned in the deployed position and the hair extensions 58 are positioned in the clips 56 on selected ones of the slats 38. In this way the hair extensions 58 are suspended from the selected slat 38. The hook 18 is positioned on the support 13 to store the hair extensions 58 in a vertical orientation. Thus, the hair extensions 58 are stored without becoming deformed or entangled thereby enhancing a service life of the hair extensions 69. The member 22, the slats 38 and the hair extensions 58 are selectively positioned in the bag for storage, travel and purposes requiring the hair extensions 58 to be enclosed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hair extension storage assembly being configured to store a plurality of hair extensions, said assembly comprising:

a hanger being configured to be suspended from a support, said hanger having a first end and a second end, of said hanger being curved adjacent to said second end such that said second end is directed toward said first end to define a hook wherein said hook is configured to engage the support;

a member being attached to said hanger wherein said member is configured to be suspended from the support when said hanger is positioned on the support, said member having a first end, a second end and a first surface extending therebetween, said second end of said hanger being coupled to said first end of said member, said member being elongated between said first end and said second end of said member;

a plurality of slats, each of said slats being pivotally coupled to said member, each of said slats being selectively positioned in a deployed position having each of said slats being oriented perpendicular to said member, each of said slats being positioned in a stored position having each of said slats extending downwardly along said member;

a plurality of clips, each of said clips being coupled to an associated one of said slats wherein each of said clips is configured to releasably engage a hair extension thereby facilitating the hair extension to be stored in a vertical orientation without deforming or crumpling; and a rod having a first end and a second end, said first end of said rod being coupled to said second end of said member, said rod having a ring being coupled to said second end of said rod wherein said ring is configured to be selectively positioned on the support.

2. The assembly according to claim 1, wherein each of said slats has a first end, a second end and a first surface extending therebetween, said first end corresponding to each of said slats being pivotally coupled to said first surface of said member, said slats being spaced apart from each other and being distributed between said first end and said second end of said member.

3. The assembly according to claim 2, wherein said plurality of slats is arranged into a set of first slats and a set of second slats, said first slats extending away from an opposite side of said member with respect to said second slats when said first and second slats are positioned in said deployed position, each of said set of first slats and said set of second slats including a plurality of middle slats, a topmost slat and a bottommost slat with respect to said member.

4. The assembly according to claim 3, wherein each of said clips is positioned on said first surface of said associated slat, each of said middle slats corresponding to each of said set of first and second slats having a pair of said clips being positioned thereon.

5. The assembly according to claim 4, wherein each of said clips includes a plurality of fingers each being biased to frictionally engage said first surface of said associated slat wherein each of said fingers on each of said clips is configured to have the hair extension positioned between said fingers and said slat to retain the hair extension on said associated slat for storage.

6. The assembly according to claim 1, further comprising a storage bag having said member and each of said slats being selectively positioned therein for transporting the hair extensions, said storage bag having a top wall, a bottom wall and a front wall extending therebetween, said front wall having a cut extending into an interior of said bag, said cut extending between said top wall and said bottom wall.

7. The assembly according to claim 6, wherein said top wall has a first opening extending into said interior of said bag, said hanger being extended through said first opening when said member and said slats are positioned in said bag.

8. The assembly according to claim 7, wherein said bottom wall has a second opening extending into said interior of said bag, said rod being extended through said second opening when said member and said slats are positioned in said bag.

9. The assembly according to claim 6, further comprising a fastener being coupled to said front wall of said bag, said fastener being coextensive with said cut, said fastener selectively opening and closing said cut.

10. A hair extension storage assembly being configured to store a plurality of hair extensions, said assembly comprising:

a hanger being configured to be suspended from a support, said hanger having a first end and a second end, of said hanger being curved adjacent to said second end such that said second end is directed toward said first end to define a hook wherein said hook is configured to engage the support;

a member being attached to said hanger wherein said member is configured to be suspended from the support when said hanger is positioned on the support said member having a first end, a second end and a first surface extending therebetween, said second end of said hanger being coupled to said first end of said member, said member being elongated between said first end and said second end of said member;

a rod having a first end and a second end, said first end of said rod being coupled to said second end of said member, said rod having a ring being coupled to said second end of said rod wherein said ring is configured to be selectively positioned on the support;

a plurality of slats, each of said slats being pivotally coupled to said member, each of said slats being selectively positioned in a deployed position having each of said slats being oriented perpendicular to said member, each of said slats being positioned in a stored position having each of said slats extending downwardly along said member, said member having a first end, a second end and a first surface extending therebetween, said first end corresponding to each of said slats being pivotally coupled to said first surface of said member, said slats being spaced apart from each other and being distributed between said first end and said second end of said member, said plurality of slats being arranged into a set of first slats and a set of second slats, said first slats extending away from an opposite side of said member with respect to said second slats when said first and second slats are positioned in said deployed position, each of said set of first slats and said set of second slats including a plurality of middle slats, a topmost slat and a bottommost slat with respect to said member;

a plurality of clips, each of said clips being coupled to an associated one of said slats wherein each of said clips is configured to releasably engage a hair extension thereby facilitating the hair extension to be stored in a vertical orientation without deforming or crumpling, each of said middle slats corresponding to each of said set of first and second slats having a pair of said clips being positioned thereon, each of said clips being positioned on said first surface of said associated slat, each of said clips including a plurality of fingers each being biased to frictionally engage said first surface of said associated slat wherein each of said fingers on each of said clips is configured to have the hair extension positioned between said fingers and said slat to retain the hair extension on said associated slat for storage;

a storage bag having said member and each of said slats being selectively positioned therein for transporting the hair extensions, said storage bag having a top wall, a bottom wall and a front wall extending therebetween, said front wall having a cut extending into an interior of said bag, said cut extending between said top wall and said bottom wall, said top wall having a first opening extending into said interior of said bag, said hanger being extended through said first opening when said member and said slats are positioned in said bag, said bottom wall having a second opening extending into said interior of said bag, said rod being extended through said second opening when said member and said slats are positioned in said bag; and a fastener being coupled to said front wall of said bag, said fastener being coextensive with said cut, said fastener selectively opening and closing said cut.

* * * * *